US008171767B2

(12) United States Patent
Shore et al.

(10) Patent No.: US 8,171,767 B2
(45) Date of Patent: May 8, 2012

(54) MODULAR ROLLING MILL

(75) Inventors: T. Michael Shore, Princeton, MA (US); S. Mark Shore, Dudley, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 190 days.

(21) Appl. No.: 12/797,656

(22) Filed: Jun. 10, 2010

(65) Prior Publication Data

US 2011/0302983 A1 Dec. 15, 2011

(51) Int. Cl.
*B21B 31/00* (2006.01)

(52) U.S. Cl. ..... 72/249; 72/449

(58) Field of Classification Search ..... 72/199, 72/224, 226, 234, 235, 237, 249, 449
See application file for complete search history.

(56) References Cited

U.S. PATENT DOCUMENTS

| | | | | |
|---|---|---|---|---|
| 3,945,234 | A | 3/1976 | Steinbock | |
| 3,996,781 | A | 12/1976 | Nuckel | |
| 4,079,608 | A * | 3/1978 | Properzi | 72/5 |
| 4,385,530 | A * | 5/1983 | Holthoff | 475/6 |
| 5,195,345 | A | 3/1993 | Porombka et al. | |
| 5,325,697 | A * | 7/1994 | Shore et al. | 72/234 |
| 5,595,083 | A | 1/1997 | Shore | |
| 6,000,266 | A | 12/1999 | Strecker et al. | |
| 6,053,022 | A | 4/2000 | Shore | |
| 7,191,629 | B1 | 3/2007 | Shore et al. | |
| 7,523,632 | B2 | 4/2009 | Shore | |

FOREIGN PATENT DOCUMENTS

| | | |
|---|---|---|
| EP | 0933145 A2 | 8/1999 |
| EP | 0987067 A2 | 3/2000 |

OTHER PUBLICATIONS

PCT International Search Report mailed Oct. 5, 2011 corresponding to PCT International Application No. PCT/US2011/036613 filed May 16, 2011 (10 pages).

* cited by examiner

*Primary Examiner* — Shelley Self

(57) ABSTRACT

A modular rolling mill has a mill pass line along which products are rolled in a rolling direction. The rolling mill comprises first gear units arranged along a first line parallel to the mill pass mill line. Each first gear unit is driven individually by a motor and has a pair of mechanically interconnected output shafts. Second gear units are arranged along a second line between and parallel to both the first line and the mill pass line. Each second gear unit has a pair of mechanically interconnected input shafts driving a pair of output shafts. Rolling units are arranged in succession along the mill pass line. Each rolling unit is driven by an input shaft and has a pair of mechanically interconnected roll shafts carrying work rolls. First couplings connect the output shafts of each first gear unit to input shafts of two successive gear units, and second couplings releasably connect the output shafts of the second gear units to the input shafts of two successive rolling units.

9 Claims, 5 Drawing Sheets

MODULAR ROLLING MILL

BACKGROUND DISCUSSION

1. Field of the Invention

This invention relates generally to rolling mills, and is concerned in particular with the provision of an improved modular finishing mill for rolling long products such as rods, bars and the like.

2. Description of the Prior Art

With reference to FIG. 5A, a known modular finishing mill of the type described in U.S. Pat. No. 5,595,083 (Shore) comprises a plurality of rolling units $R_1$-$R_5$ arranged sequentially on a mill pass line P along which products are rolled in a rolling direction indicated by arrow 10. Gear units $A_1$-$A_4$ are arranged along a line L parallel to the mill pass line. The gear units are driven individually by motors $M_1$-$M_4$ and are offset with respect to the rolling units in the rolling direction. A continuous drive train is provided by connecting each gear unit to two successive rolling units.

Typically, when rolling smaller product sizes, e.g., rods with diameters of 5.0-6.5 mm, all rolling units $R_1$-$R_5$ are employed, at finishing speeds of up to 120 m/s and at tonnage rates of 70-90 tons/hr. In this case, the mill benefits from the power provided by all of the motors $M_1$-$M_4$ acting through the continuous drive train provided by the coupling of each gear unit to two successive rolling units. However, when rolling larger product sizes, at lower speeds and at higher tonnage rates on the order of 150 tons/hr, one or more of the rolling units at the exit end of the mill are typically removed from the pass line. If two rolling units are removed, as shown in FIG. 5B, the last motor $M_4$ is in effect decoupled from the continuous drive train, thus reducing the power available to drive the mill at a time when the demand for power has increased as a result of the higher tonnage rates being produced. In order to compensate for such power deficiencies, the mills are equipped with larger motors, which disadvantageously increases the overall cost of the mill.

In the above described mill, the rolling units $R_1$-$R_5$ each comprise two oppositely inclined roll pairs. This design is unique to the modular mill concept, and is not readily adaptable for use at other mill locations, for example in post finishing mills of the type described in U.S. Pat. No. 5,325,697 (Shore et al.).

SUMMARY OF THE INVENTION

An objective of the present invention is the provision of a modular finishing mill driven by multiple motors, with a continuous drive train that employs the total power of all motors, irrespective of the number of rolling units in service at any given time.

A companion objective of the present invention is the provision of a modular rolling mill in which identical rolling units have single pairs of work rolls on inclined axes, and in which the rolling units may be driven from opposite sides to thereby accommodate an alternating reverse orientation of the rolling units accompanied by an alternating opposite inclination of their work rolls along the mill pass line.

A modular rolling mill in accordance with the present invention comprises a plurality of first gear units arranged along a first line parallel to the mill pass line. Each first gear reduction unit is driven separately by a motor and has a pair of mechanically interconnected output shafts.

Second gear units are arranged along a second line between and parallel to both the first line and the mill pass line. The second gear units are offset with respect to the first gear units in the direction of rolling, and each second gear unit has a pair of input shafts mechanically connected to a pair of output shafts.

A continuous drive train is provided by coupling the output shafts of each successive first gear unit to the input shafts of two successive second gear units.

Rolling units are arranged in succession along the pass line. The rolling units are interchangeable one for the other at successive locations along the pass line. Each rolling unit has a pair of work rolls carried on mechanically interconnected inclined roll shafts driven by an input shaft. The output shafts of the second gear units are detachably coupled to the input shafts of successive rolling units.

When viewed in the direction of rolling, the output shafts of the first and second gear units are advantageously driven at progressively higher rotational speeds, and the input shafts of the rolling units are connected to the respective pairs of roll shafts by gears sized to effect a percentage speed increase which is the same for each rolling unit.

In order to effect twist free rolling, the input shafts of the rolling units project from opposite sides to thereby accommodate an alternating reverse orientation of the rolling units and an alternating opposite inclination of their roll shafts along the mill pass line.

These and other features and attendant advantages of the present invention will now be described in further detail with reference to the accompanying drawings, wherein:

DETAILED DESCRIPTION

Figure 1:
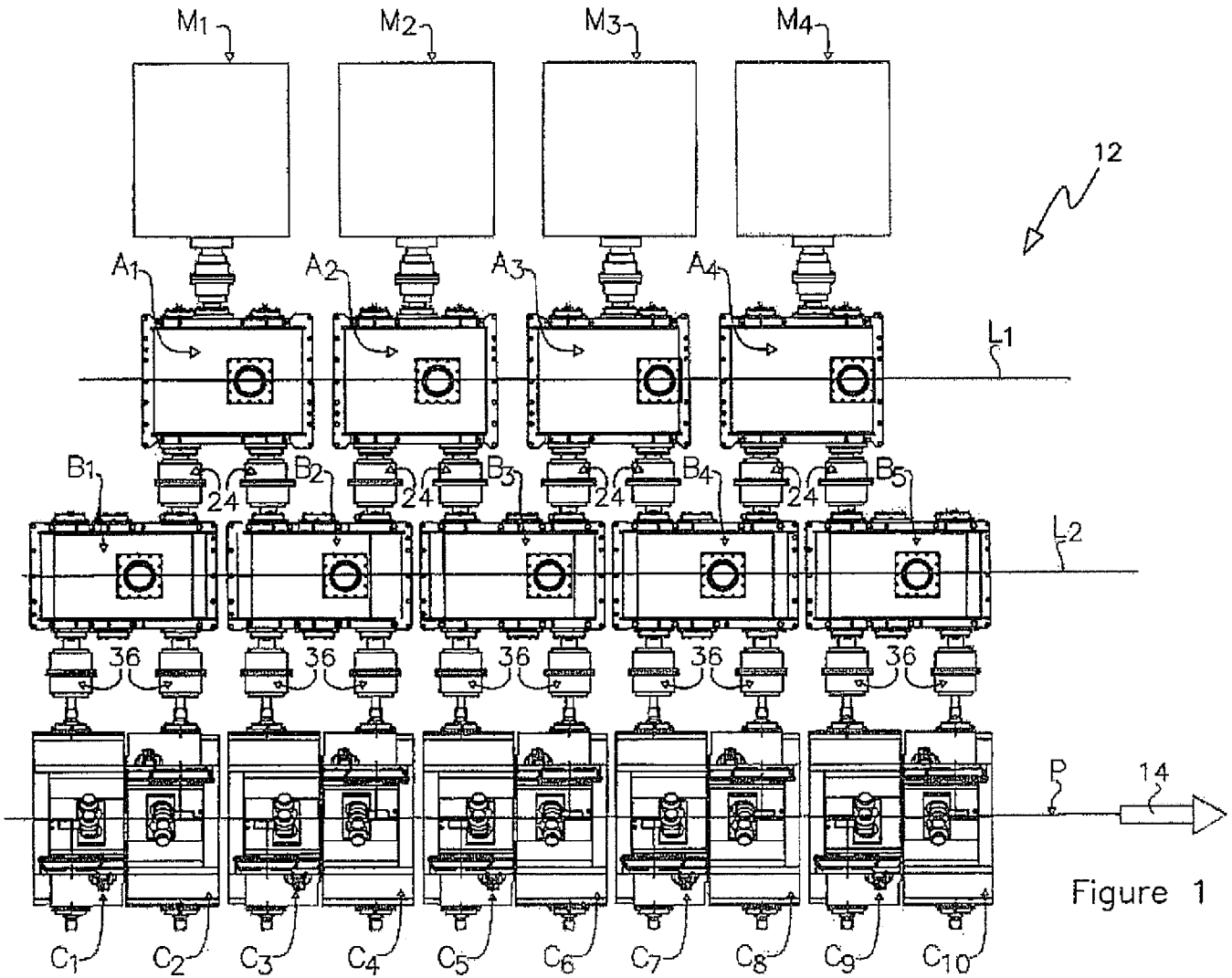
FIG. 1 is a plan view of a modular finishing mill in accordance with the present invention.

With reference initially to FIGS. 1 and 2, a modular rolling mill in accordance with the present invention is shown at 12. The rolling mill is designed to roll long products such as bars, rods and the like along a mill pass line "P" in a rolling direction indicated diagrammatically by arrow 14. The mill includes first gear units $A_1$-$A_4$ arranged along a first line $L_1$ parallel to the mill pass line P. The first gear units are driven respectively by motors $M_1$-$M_4$ mechanically connected to pairs of output shafts 16 by internal gear sets 18.

Second gear units $B_1$-$B_5$ are arranged along a second line $L_2$ between and parallel to both the first line $L_1$ and the mill pass line P. Each second gear unit has a pair of shafts 20 mechanically interconnected by a gear set 22. When viewed in the rolling direction, the second gear units $B_1$-$B_5$ are offset with respect to the first gear units $A_1$-$A_4$. First couplings 24 serve to connect the shafts 16 of each first gear unit $A_1$-$A_4$ to the shafts 20 of two successive second gear units $B_1$-$B_5$.

Figure 4:
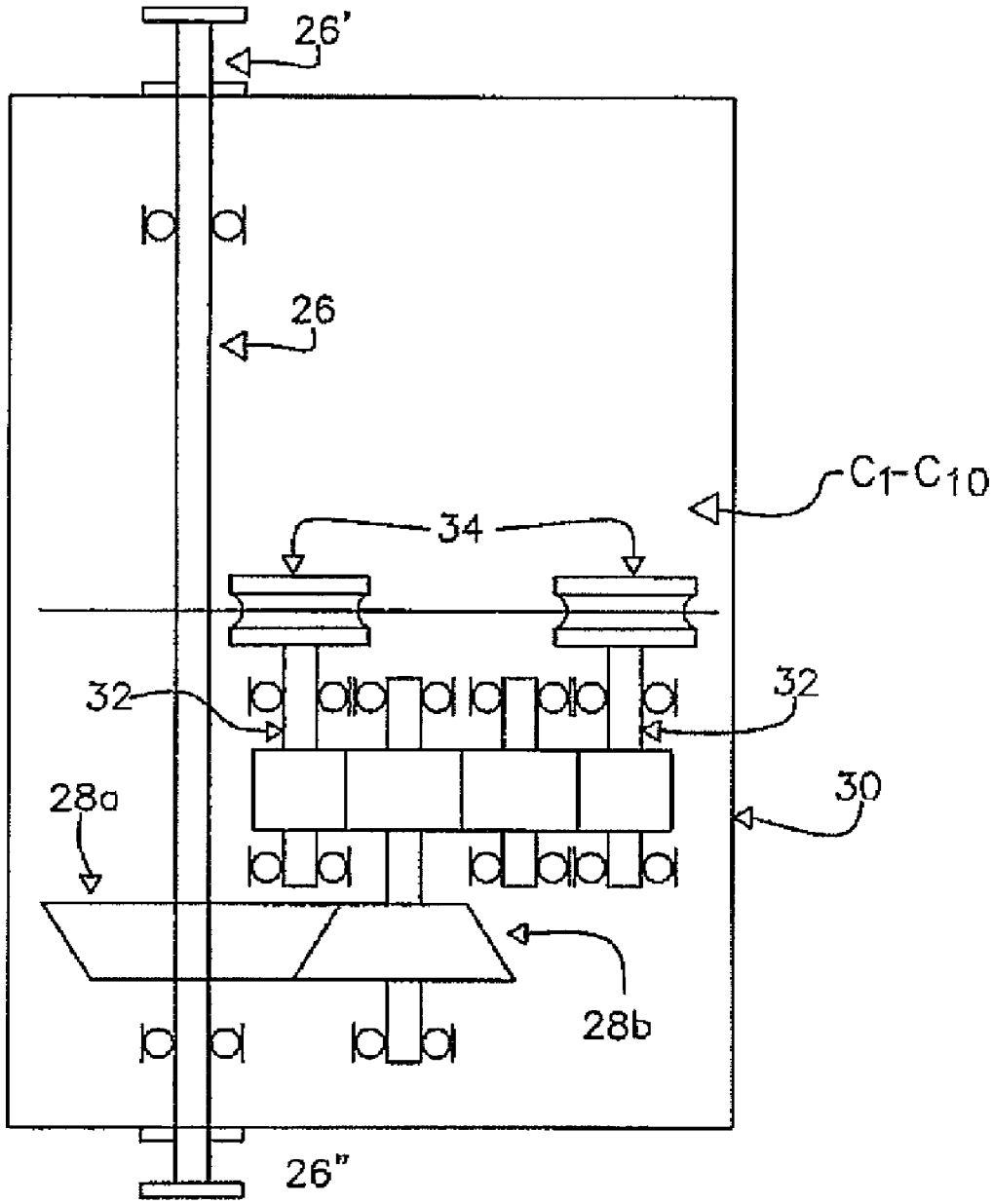
FIG. 4 is an enlarged diagrammatic illustration of the internal drive of a typical rolling unit.
Figure 5A:
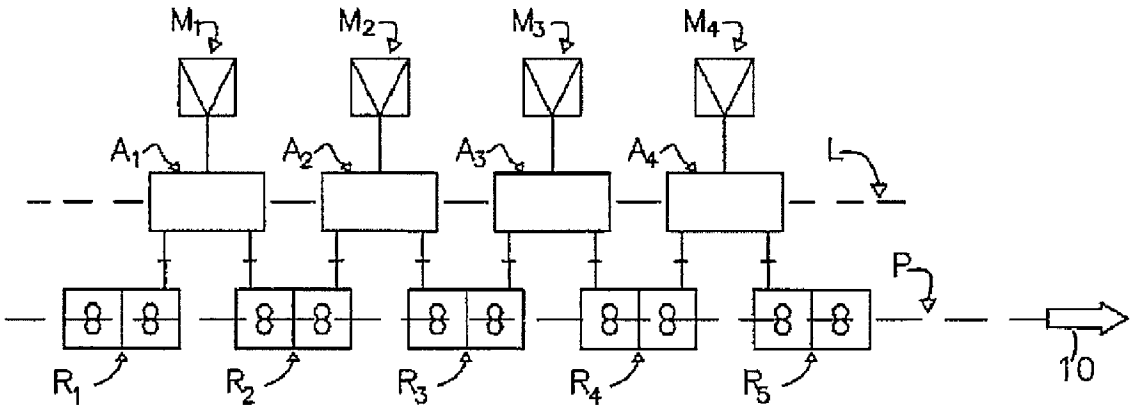
Figure 5A (Prior Art)
FIGS. 5A and 5B are diagrammatic illustrations of a prior art modular finishing mill.
Figure 5B:
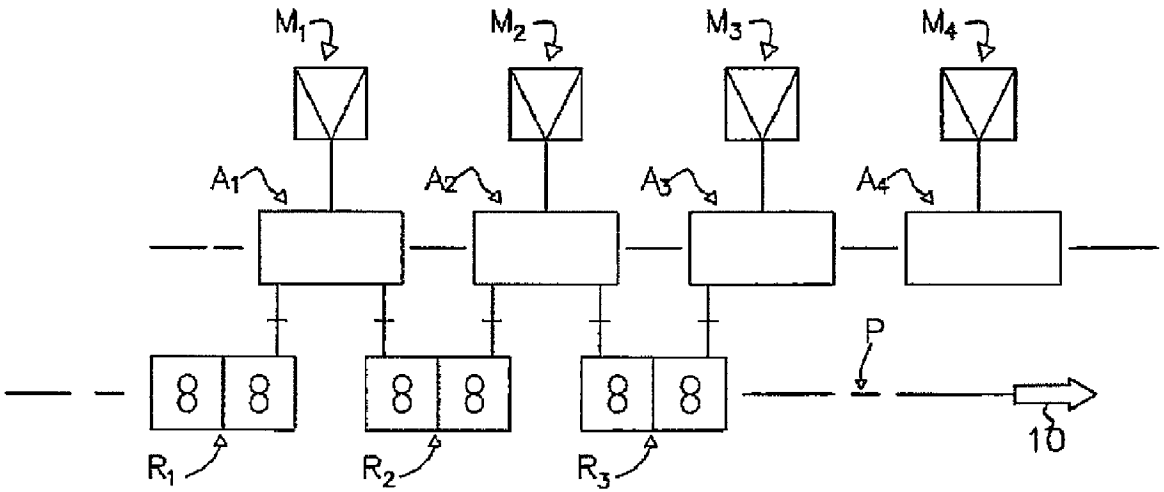
Figure 5B (Prior Art)

Rolling units $C_1$-$C_{10}$ are arranged in succession along the mill pass line P. The rolling units are interchangeable one for the other. As can be best seen by further reference to FIG. 4, each rolling unit has a shaft 26 connected via bevel gear 28*a*, 28*b* and a gear set 30 to roll shafts 32 carrying work rolls 34.

Figure 2B:
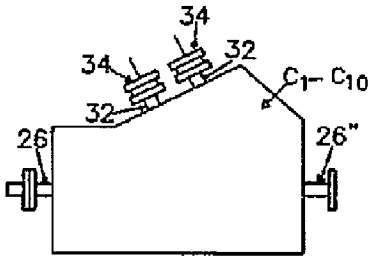
FIGS. 2A and 2B are end views showing reverse orientations of the rolling units.
Figure 2A:
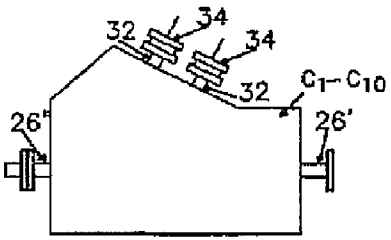

With reference additionally to FIGS. 2A and 2B, the roll shafts 32 are inclined at a 45° angle, and the shafts 26 have ends 26' and 26" projecting from opposite sides of the rolling unit housings. Second couplings 36 serve to connect the shafts 20 of the second gear units $B_1$-$B_5$ to the shafts 26 of two successive rolling units C. The orientation of the rolling units C may be alternately reversed along the mill pass line P as depicted in FIGS. 2A and 2B to accommodate an alternating opposite inclination of the roll shafts required for twist free rolling of products.

As viewed in the rolling direction, the gear sets 18 of the first rolling units $A_2$-$A_4$ are sized to drive the shafts 16 at progressively higher rotational speeds. Likewise, and again as viewed in the rolling direction, the gear sets 22 of the second gear units $B_1$-$B_5$ are sized to drive the shafts 18 at progressively higher rotational speeds.

However, the bevel gears 28*a*, 28*b* of the rolling units $C_1$-$C_{10}$ are sized to provide a percentage speed increase which is the same for each rolling unit. This, when coupled with the reversibility of the rolling units as depicted in FIGS. 2A and 2B, makes the rolling units interchangeable one for the other at any location along the mill pass line P, which in turn makes it possible to operate the mill with a minimum number of spare rolling units.

Figure 3:
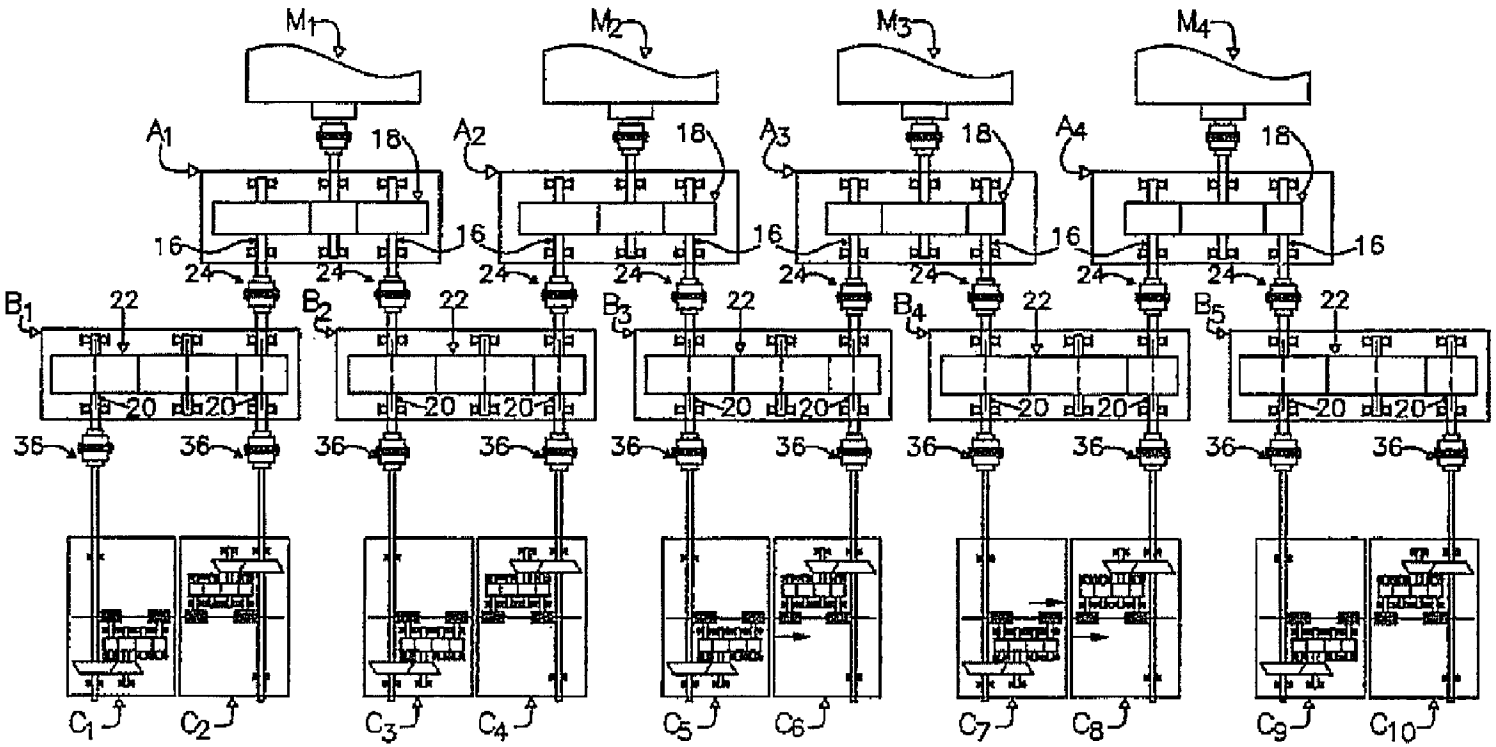
FIG. 3 is a diagrammatic illustration of the mill drive train.
Figure 6:
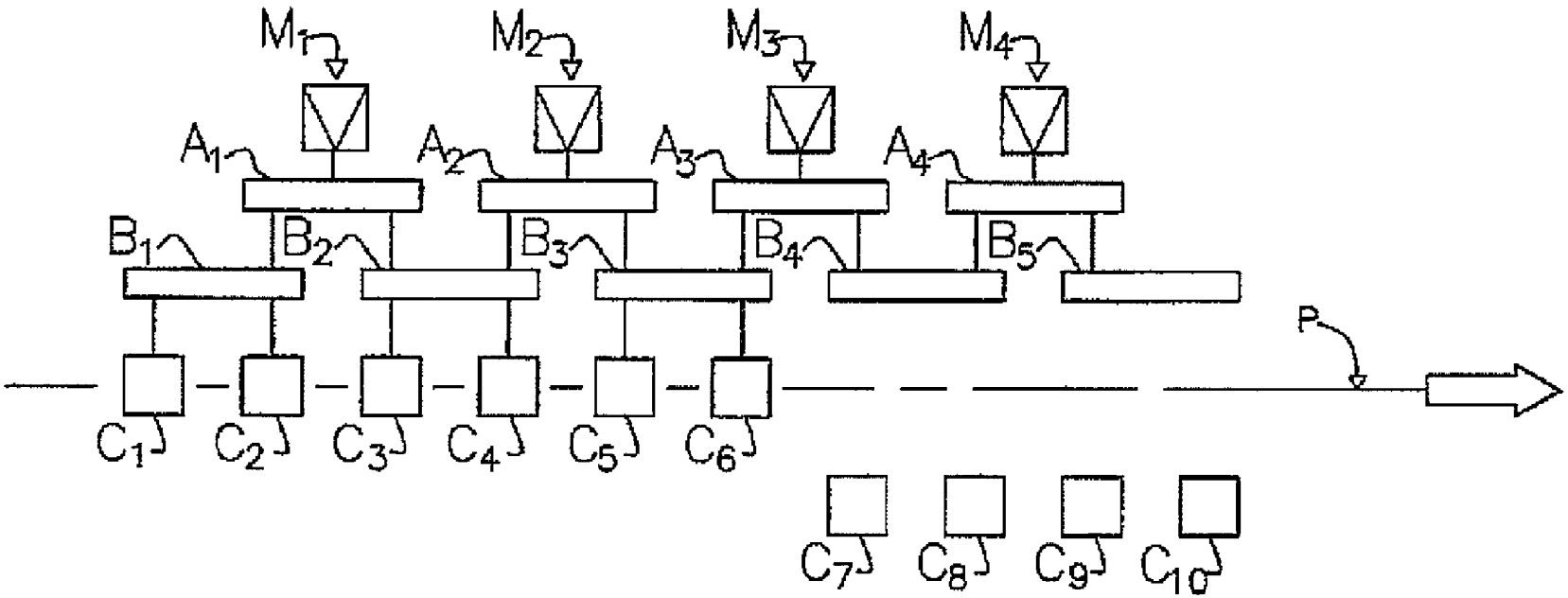
FIG. 6 is a diagrammatic illustration of the modular finishing mill of the present invention with selected rolling units removed from the mill pass line.

It should also be noted that with the continuous drive arrangement provided by the first and second gear units $A_1$-$A_4$ and $B_1$-$B_5$, all of the motors $M_1$-$M_4$ are available to power the mill, irrespective of the number of rolling units C being employed. Thus, for example, as depicted in FIGS. 1 and 3, all of the motors $M_1$-$M_4$ are mechanically coupled to all rolling units $C_1$-$C_{10}$ when rolling smaller product sizes. Larger product sizes can be rolled at higher tonnage rates by removing selected rolling units from the mill pass line P. One such case is depicted in FIG. 6 where although rolling units $C_7$-$C_{10}$ have been shifted off of the mill pass line, all four motors $M_1$-$M_4$ remain coupled to the remaining active rolling units.

The invention claimed is:

1. A modular rolling mill having a mill pass line along which products are rolled in a rolling direction, said rolling mill comprising:

a plurality of first gear units arranged along a first line parallel to said mill pass mill line, each first gear unit being driven individually by a motor and having a pair of mechanically interconnected output shafts;

a plurality of second gear units arranged along a second line between and parallel to both said first line and said mill pass line, each second gear unit having a pair of mechanically interconnected input shafts driving a pair of output shafts;

a plurality of rolling units arranged in succession along the pass line, each rolling unit being driven by an input shaft and having a pair of mechanically interconnected roll shafts carrying work rolls;

first coupling means for connecting the output shafts of each first gear unit to input shafts of two successive second gear units; and second coupling means for releasably connecting the output shafts of said second gear units to the input shafts of two successive rolling units.

2. The modular rolling mill of claim 1 wherein said rolling units are interchangeable one for the other at successive locations along the mill pass line.

3. The modular rolling mill of claim 1 wherein as viewed in the rolling direction, the output shafts of said first gear units are driven at progressively higher rotational speeds.

4. The modular rolling mill of claim 3 wherein, as viewed in the rolling direction, the output shafts of said second gear units are driven at progressively higher rotational speeds.

5. The modular rolling mill of claim 1 wherein the input shaft of each rolling unit is connected to the respective pairs of mechanically interconnected roll shafts via gears sized to effect a percentage speed increase which is the same of each rolling unit.

6. The modular rolling mill of claim 2 wherein the input shaft of each rolling unit is connected to the respective pairs of mechanically interconnected roll shafts via gears sized to effect a percentage speed increase which is the same of each rolling unit.

7. The modular rolling mill of claim 3 wherein the input shaft of each rolling unit is connected to the respective pairs of mechanically interconnected roll shafts via gears sized to effect a percentage speed increase which is the same of each rolling unit.

8. The modular rolling mill of claim 4 wherein the input shaft of each rolling unit is connected to the respective pairs of mechanically interconnected roll shafts via gears sized to effect a percentage speed increase which is the same of each rolling unit.

9. The rolling mill of claim 1 wherein said rolling units are identically configured with inclined roll shafts, and wherein the input shafts of the rolling units project from opposite sides to thereby accommodate an alternating reverse orientation of the rolling units and an alternating opposite inclination of their roll shafts along the mill pass line.

* * * * *